US008118394B2

(12) United States Patent
Suzuki et al.

(10) Patent No.: US 8,118,394 B2
(45) Date of Patent: Feb. 21, 2012

(54) DROPLET EJECTING DEVICE

(75) Inventors: Tadashi Suzuki, Kanagawa (JP); Masaki Kataoka, Kanagawa (JP); Atsumichi Imazeki, Kanagawa (JP); Yoshihira Rai, Kanagawa (JP); Yujiro Fukuda, Kanagawa (JP); Takaaki Sekiyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 519 days.

(21) Appl. No.: 12/344,735

(22) Filed: Dec. 29, 2008

(65) Prior Publication Data

US 2009/0284566 A1 Nov. 19, 2009

(30) Foreign Application Priority Data

May 13, 2008 (JP) ..... 2008-126543

(51) Int. Cl.
*B41J 2/165* (2006.01)

(52) U.S. Cl. ..... 347/29; 347/32

(58) Field of Classification Search ..... None
See application file for complete search history.

(56) References Cited

U.S. PATENT DOCUMENTS 5,517,219 A * 5/1996 Uchida ..... 347/24
5,557,306 A 9/1996 Fukushima et al.
6,158,839 A 12/2000 Fukushima et al.
6,481,826 B1 * 11/2002 Hara et al. ..... 347/29
2002/0080207 A1 6/2002 Kanda et al.
2004/0080563 A1 * 4/2004 Leemhuis ..... 347/33
2005/0007412 A1 1/2005 Nishikawa et al.
2005/0046666 A1 3/2005 Horio et al.
2006/0209152 A1 * 9/2006 Baringa et al. ..... 347/104

FOREIGN PATENT DOCUMENTS

| | | | |
|---|---|---|---|
| JP | 03093548 A | * | 4/1991 |
| JP | 6-328731 | | 11/1994 |
| JP | 7-101081 | | 4/1995 |
| JP | 8-039830 | | 2/1996 |
| JP | 10-323987 | | 12/1998 |
| JP | 2001-138546 | | 5/2001 |
| JP | 2002-052742 | | 2/2002 |
| JP | 2004-160801 | | 6/2004 |
| JP | 3535885 | | 6/2004 |
| JP | 2005-22193 | | 1/2005 |
| JP | 2005-074767 | | 3/2005 |
| JP | 2007-168355 | | 7/2007 |
| JP | 2008-055756 | | 3/2008 |

* cited by examiner

*Primary Examiner* — Stephen Meier
*Assistant Examiner* — Tracey McMillion
(74) *Attorney, Agent, or Firm* — Fildes & Outland, P.C.

(57) ABSTRACT

A droplet ejecting device including: plural droplet ejecting heads that eject droplets; a transporting body, disposed to face nozzle surfaces of the droplet ejecting heads, that transports a recording medium; and a head holding member that holds the droplet ejecting heads movably along droplet ejecting directions respectively is provided.

12 Claims, 16 Drawing Sheets

DROPLET EJECTING DEVICE

CROSS-REFERENCE TO RELATED APPLICATION

This application is based on and claims priority under 35 USC 119 from Japanese Patent Application No. 2008-126543 filed May 13, 2008.

BACKGROUND

Technical Field

The present invention relates to a droplet ejecting device.

SUMMARY

An aspect of the present invention is a droplet ejecting device including: plural droplet ejecting heads that eject droplets; a transporting body, disposed to face nozzle surfaces of the droplet ejecting heads, that transports a recording medium; and a head holding member that holds the droplet ejecting heads movably along droplet ejecting directions respectively.

BRIEF DESCRIPTION OF THE DRAWINGS

Exemplary embodiments of the invention will be described in detail with reference to the following figures, wherein:

FIG. 8A illustrates a case using a pressure-applying pump and FIG. 8B illustrates a case using a suction pump;

DETAILED DESCRIPTION

Figure 1:
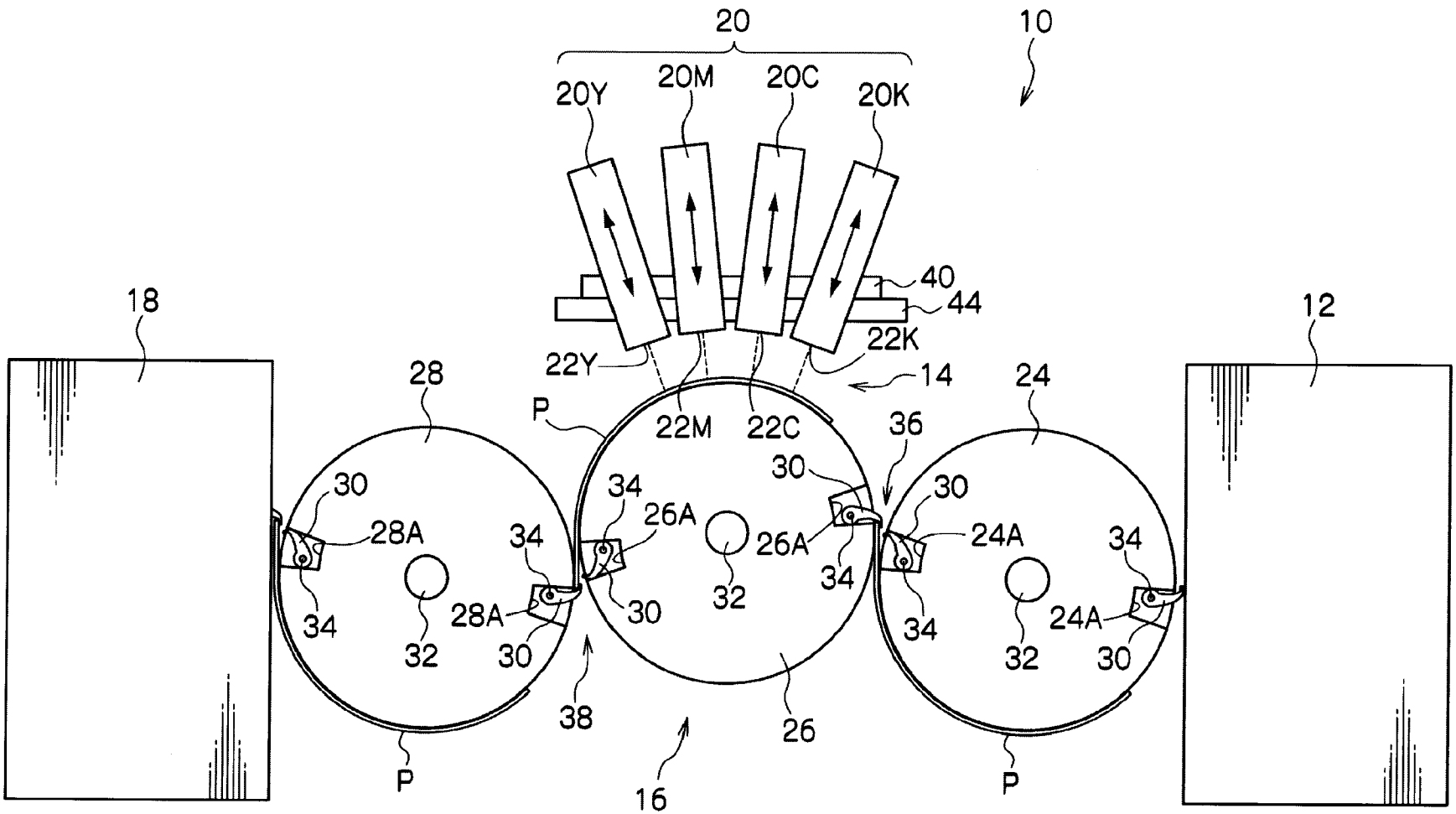
FIG. 1 is a schematic front view showing the structure of an inkjet recording device relating to the present exemplary embodiment.

Preferred exemplary embodiments of the present invention are described in detail hereinafter on the basis of the examples illustrated in the drawings. The schematic structure of an inkjet recording device 10, that serves as an example of a droplet ejecting device relating to the present invention, is shown in FIG. 1. Accordingly, hereinafter, explanation will be given with droplet ejecting heads being inkjet recording heads 20, and a recording medium on which an image is recorded by the droplet ejecting heads being a recording sheet P.

As shown in FIG. 1, the inkjet recording device 10 includes: a sheet feeding section 12 that accommodates the recording sheets P before images are recorded thereon; an image recording section 14 that records an image on the recording sheet P supplied from the sheet feeding section 12; a transporting section 16 that transports the recording sheet P to the image recording section 14; and a sheet discharging section 18 that accommodates the recording sheets P after images are recorded thereon by the image recording section 14.

The image recording section 14 includes the inkjet recording heads 20. The inkjet recording heads 20 are lined up in the order of yellow (Y), magenta (M), cyan (C) and black (K) from the downstream side with respect to the transporting direction of the recording sheet P. Ink droplets are ejected by known mechanisms of a thermal system, a piezoelectric system, or the like.

Note that various types of inks, such as aqueous (water) inks, oily inks, solvent-based inks, and the like can be used as the inks. Ink tanks (not shown) that supply inks to the respective inkjet recording heads 20Y, 20M, 20C, 20K are provided at the inkjet recording device 10.

The inkjet recording heads 20Y, 20M, 20C, 20K have nozzle surfaces 22Y, 22M, 22C, 22K at which plural nozzles (not shown) are formed. The nozzle surfaces 22Y, 22M, 22C, 22K have a recordable region that is the same extent as or larger than the maximum width of the recording sheets P for which image recording at the inkjet recording device 10 is supposed.

In explanation hereinafter that is common to the respective inkjet recording heads 20Y, 20M, 20C, 20K, the reference letters Y, M, C, K are omitted.

The inkjet recording heads 20 are held at a head holder (a head holding member) 40, and are disposed above a transporting drum 26 (to be described later) that structures the transporting section 16, and are respectively disposed along the peripheral direction of the outer peripheral surface of the transporting drum 26. Namely, the respective inkjet recording heads 20 are disposed at predetermined angles (for example, about a rotating shaft 32 as a center) with respect to one another.

Up/down moving mechanisms 42 serving as an approaching/separating section are provided at the head holder 40 for the respective inkjet recording heads 20, and can make the respective inkjet recording heads 20 approach and move away from the transporting drum 26 (move up and down) along the angles at which the inkjet recording heads 20 are disposed.

Figure 2:
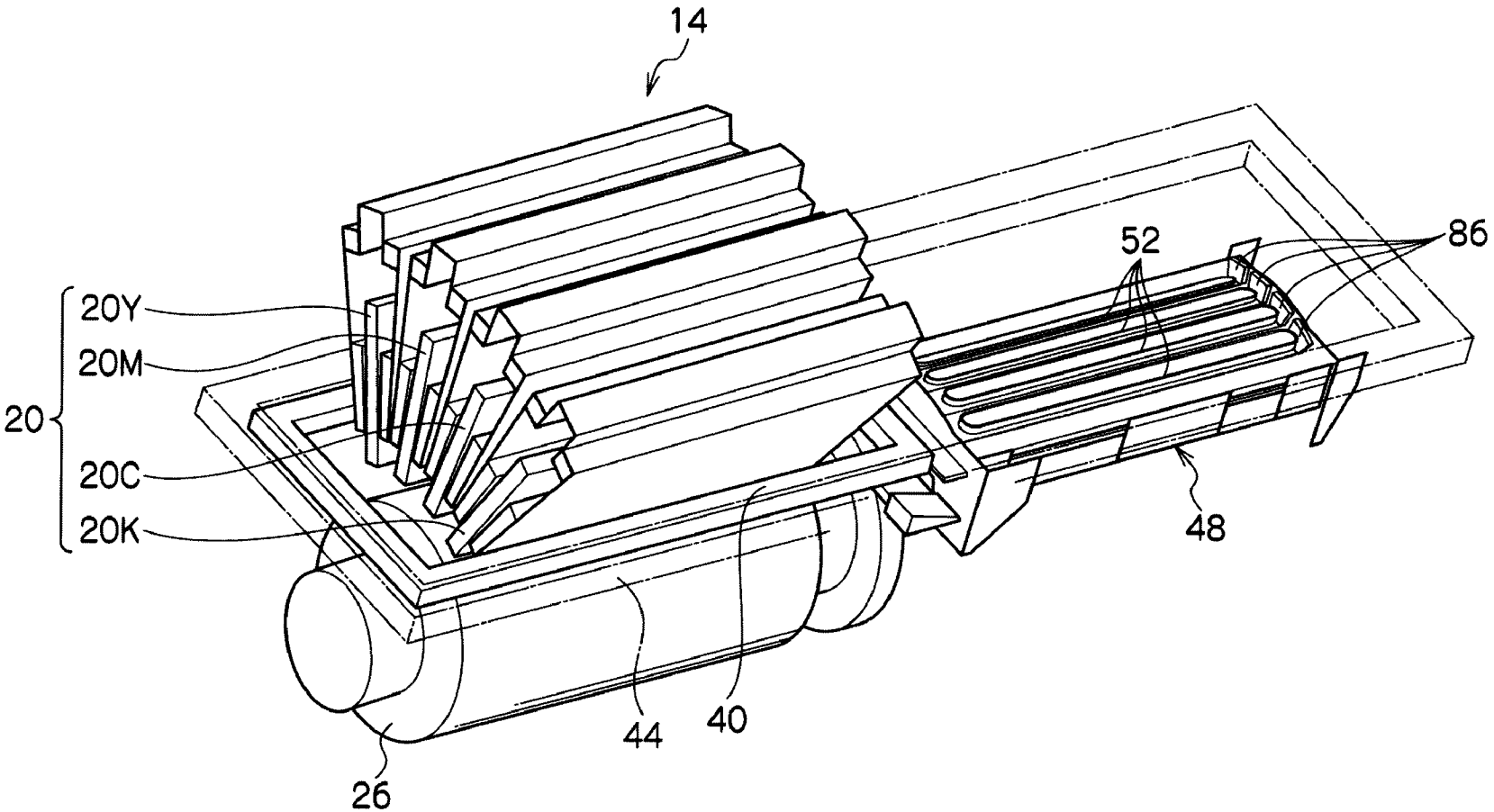
FIG. 2 is a schematic perspective view showing the structure of the inkjet recording device relating to the present exemplary embodiment.

Further, a frame body (horizontal moving section) 44, that extends in the direction orthogonal to the transporting direction of the recording sheet P, is provided beneath the head holder 40 as shown in FIG. 2. The head holder 40 can move horizontally within the frame body 44 between a facing position, at which the head holder 40 faces the transporting drum 26, and a withdrawn position, at which the head holder 40 is withdrawn from the facing position.

With regard to the structure that moves the head holder 40 horizontally, although not illustrated, the head holder 40 may be moved horizontally by using a linear motor. Or, the head holder 40 may be moved horizontally by using a rotating motor via a rack and pinion.

Wiper units 46 (see FIG. 3) serving as a cleaning section and maintenance units 48 serving as a capping section are provided so as to correspond to the respective inkjet recording units 20 at the side of the withdrawn position of the head holder 40 in the frame body 44. The wiper units 46 are disposed at the transporting drum 26 side.

Figure 4:
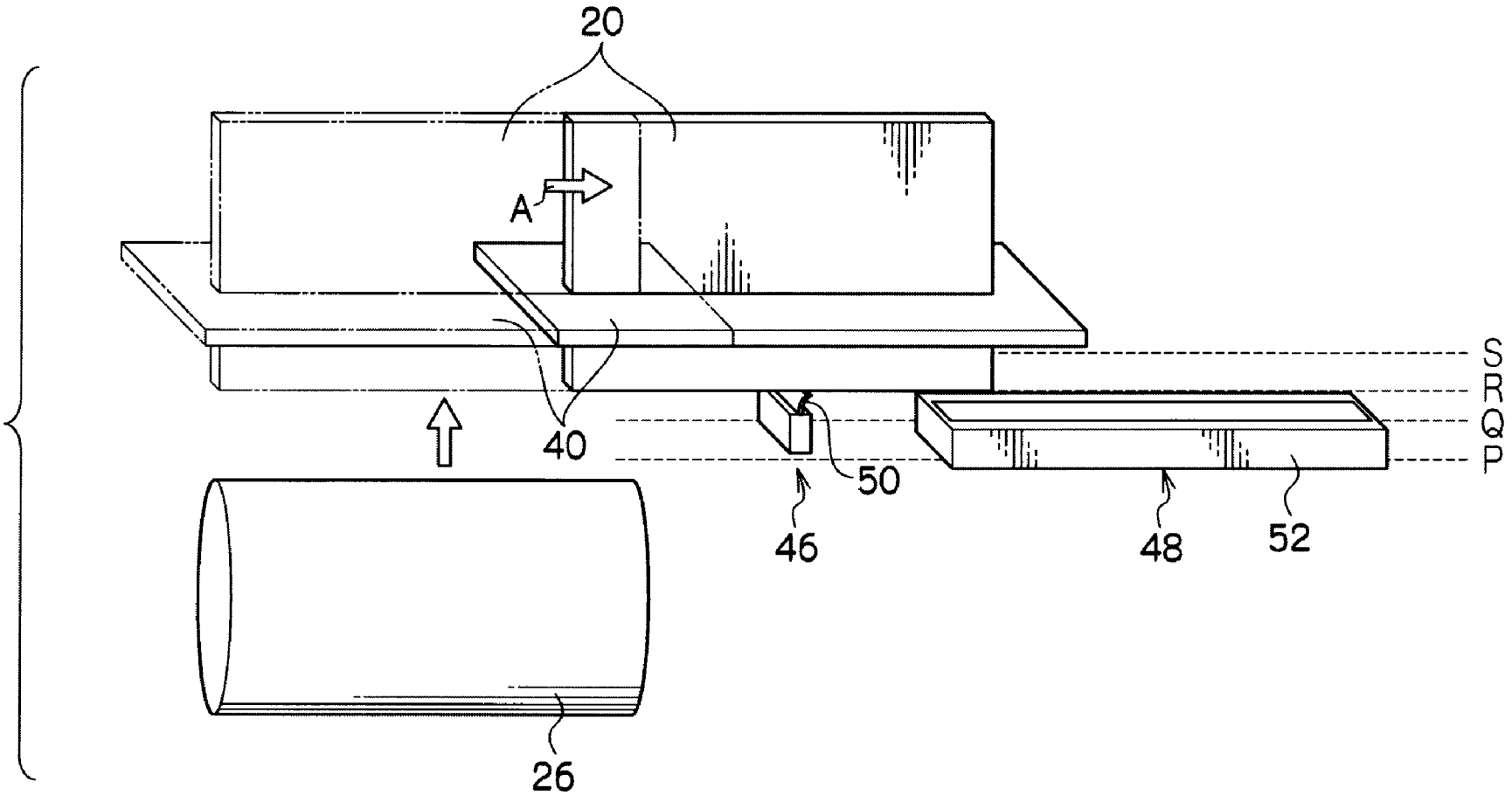
FIG. 4 is a schematic side view explaining operation of the inkjet recording head structuring the inkjet recording device relating to the present exemplary embodiment.

As shown in FIG. 4, a wiper blade 50 that cleans (wipes) the nozzle surface 22 of the inkjet recording head 20 is provided at the wiper unit 46. A capping member 52, that is for removing contaminating substances within the nozzles (not shown) of the inkjet recording head 20, is provided at the maintenance unit 48 (this will be described later).

On the other hand, as shown in FIG. 1, the transporting section 16 has: a pick-up drum 24 that takes-out one-by-one the recording sheets P that are in the sheet feeding section 12; the transporting drum 26 serving as a transporting body that transports the recording sheet P to the inkjet recording heads 20 of the image recording section 14, and whose printing surface (surface) faces the inkjet recording heads 20; and a feed-out drum 28 that feeds the recording sheet P, on which an image has been recorded, out to the sheet discharging section 18. Further, the pick-up drum 24, the transporting drum 26 and the feed-out drum 28 are respectively structured such that the recording sheet P is held at the peripheral surface thereof by an electrostatic attraction section, or by a non-electrostatic attraction section that utilizes suction, adhesion, or the like.

Grippers 30, that nip and hold the transporting direction downstream side end portions of the recording sheets P, are provided at the pick-up drum 24, the transporting drum 26 and the feed-out drum 28. For example, two sets of the grippers 30 are provided at each of the drums 24, 26, 28. In this case, each of these three drums 24, 26, 28 is structured so as to be able to hold up to two of the recording sheets P at the peripheral surface of the drum. The grippers 30 are provided within concave portions 24A, 26A, 28A, two of which are formed at the peripheral surface of each of the drums 24, 26, 28.

Namely, rotating shafts 34 are placed pivotally at predetermined positions within the concave portions 24A, 26A, 28A of the respective drums 24, 26, 28, substantially parallel to rotating shafts 32 of the drums 24, 26, 28. The plural grippers 30 are fixed to the rotating shafts 34 so as to be spaced apart from one another by predetermined intervals (e.g., uniform intervals) in the axial direction. Accordingly, due to the rotating shafts 34 rotating in both forward and reverse directions by unillustrated actuators, the grippers 30 rotate in both forward and reverse directions substantially along the peripheral directions of the respective drums 24, 26, 28, and can nip/hold or release the transporting direction downstream side end portions of the recording sheets P.

Namely, the grippers 30 rotate such that the distal end portions thereof project-out slightly from the peripheral surfaces of the respective drums 24, 26, 28. Due thereto, at a transfer position 36 where the peripheral surface of the pick-up drum 24 and the peripheral surface of the transporting drum 26 oppose one another, the recording sheet P can be transferred from the grippers 30 of the pick-up drum 24 to the grippers 30 of the transporting drum 26. Further, at a transfer position 38 where the peripheral surface of the transporting drum 26 and the peripheral surface of the feed-out drum 28 oppose one another, the recording sheet P can be transferred from the grippers 30 of the transporting drum 26 to the grippers 30 of the feed-out drum 28.

Although not illustrated, a controlling section for the inkjet recording heads 20 and a system controlling section are provided at the inkjet recording device 10. The controlling section for the inkjet recording heads 20 determines the ejection timings of ink drops and the nozzles to be used in accordance with image signals, and applies driving signals to the nozzles. The system controlling section controls the overall operation of the inkjet recording device 10.

The up/down moving mechanism and the maintenance unit will be described hereinafter.

Figure 5:
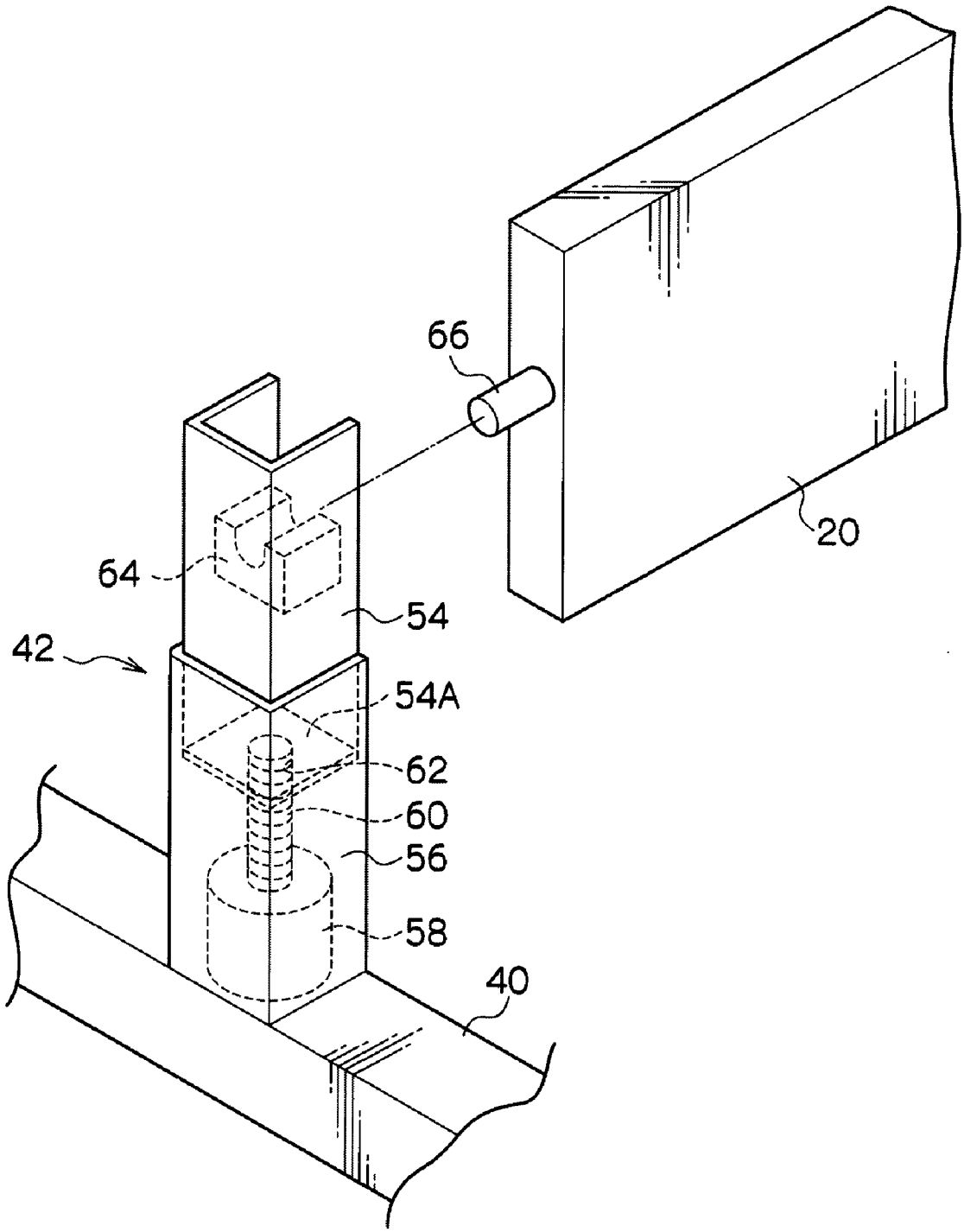
FIG. 5 is an exploded perspective view showing an up/down moving mechanism of the inkjet recording head structuring the inkjet recording device relating to the present exemplary embodiment.

As shown in FIG. 5, as an example of the up/down moving mechanism 42, guide rails 54, 56 for the respective inkjet recording heads 20 are provided at the both longitudinal direction end portions of the head holder 40 along the peripheral direction of the outer peripheral surface of the transporting drum 26 (radially along radial directions of the transporting drum 26) in the state in which the head holder 40 faces the transporting drum 26, such that the angles of the guide rails 54, 56 differ from one another.

The guide rails 54, 56 are substantially U-shaped and guide the inkjet recording heads 20. Further, the guide rails 54, 56 are provided in a state of overlapping one another. The guide rail 56 is fixed to the head holder 40, and the guide rail 54 slides along the guide rail 56.

A quadrangular pedestal (not shown) that is structured at the guide rail 56 is provided at the lower end portion of the guide rail 56. A stepping motor 58 is disposed at this pedestal. A ball screw 60 is connected to the stepping motor 58, and the ball screw 60 is rotated a predetermined angle by the driving of the stepping motor 58. Note that the stepping motors 58 are provided at both longitudinal direction end portions of the inkjet recording head 20 and are made to be synchronous with one another.

On the other hand, a quadrangular guide plate 54A that is structured at the guide rail 54 is provided at the lower end portion of the guide rail 54. A screw hole 62 is formed in the central portion of the guide plate 54A, and the ball screw 60 is screwed therein. Therefore, when the ball screw 60 rotates due to the driving of the stepping motor 58, the guide rail 54 slides with respect to the guide rail 56 along the ball screw 60 via the guide plate 54A.

A shaft-receiving portion 64 is provided at the upper end side of the guide rail 54. Shafts 66, that project-out substantially perpendicularly from the both end surfaces of the inkjet recording head 20, can be supported at the shaft-receiving portions 64. Therefore, in accordance with the sliding movement of the guide rails 54, the inkjet recording head 20 moves up and down (approaches and moves away from the outer peripheral surface of the transporting drum 26 along the radial direction), via the shaft-supporting portions 64 and the shafts 66.

Note that, here, there is a structure in which the guide rails 54 are moved up and down and the inkjet recording heads 20 are moved up and down by using the ball screws 60. However, because it suffices to be able to move the inkjet recording heads 20 up and down, the present invention is not limited to this structure. For example, the inkjet recording heads 20 may be moved by racks and pinions in accordance with racks that are provided at the guide rails, although such a structure is not illustrated.

Further, here, two of the stepping motors 58 are provided for the one inkjet recording head 20 and are made to be synchronous with one another. However, one motor may be provided, and the up/down moving mechanism 42 may be provided at the longitudinal direction central portion of the inkjet recording head 20, or the up/down moving mechanism 42 may be provided at the both longitudinal direction end portions of the inkjet recording head 20 and the driving force of the motor may be transmitted to the both longitudinal direction end portions of the inkjet recording head 20 via a pulley and a belt or the like.

On the other hand, as shown in FIG. 4, the wiper unit 46 has the wiper blade 50 that is structured by a plate-shaped elastic material such as rubber or the like. The wiper blade 50 is structured so as to, at the time of carrying out the wiping operation, be able to slidingly rub (wipe) the nozzle surface 22 of the inkjet recording head 20 at a predetermined pressure (pressure to the extent of not damaging the water-repellant film of the nozzle surface 22), due to the inkjet recording head 20 moving in the transverse direction (the direction of arrow A) that is orthogonal to the transporting direction of the recording sheet P. Due thereto, the nozzle surface 22 can be wiped well.

Figure 6:
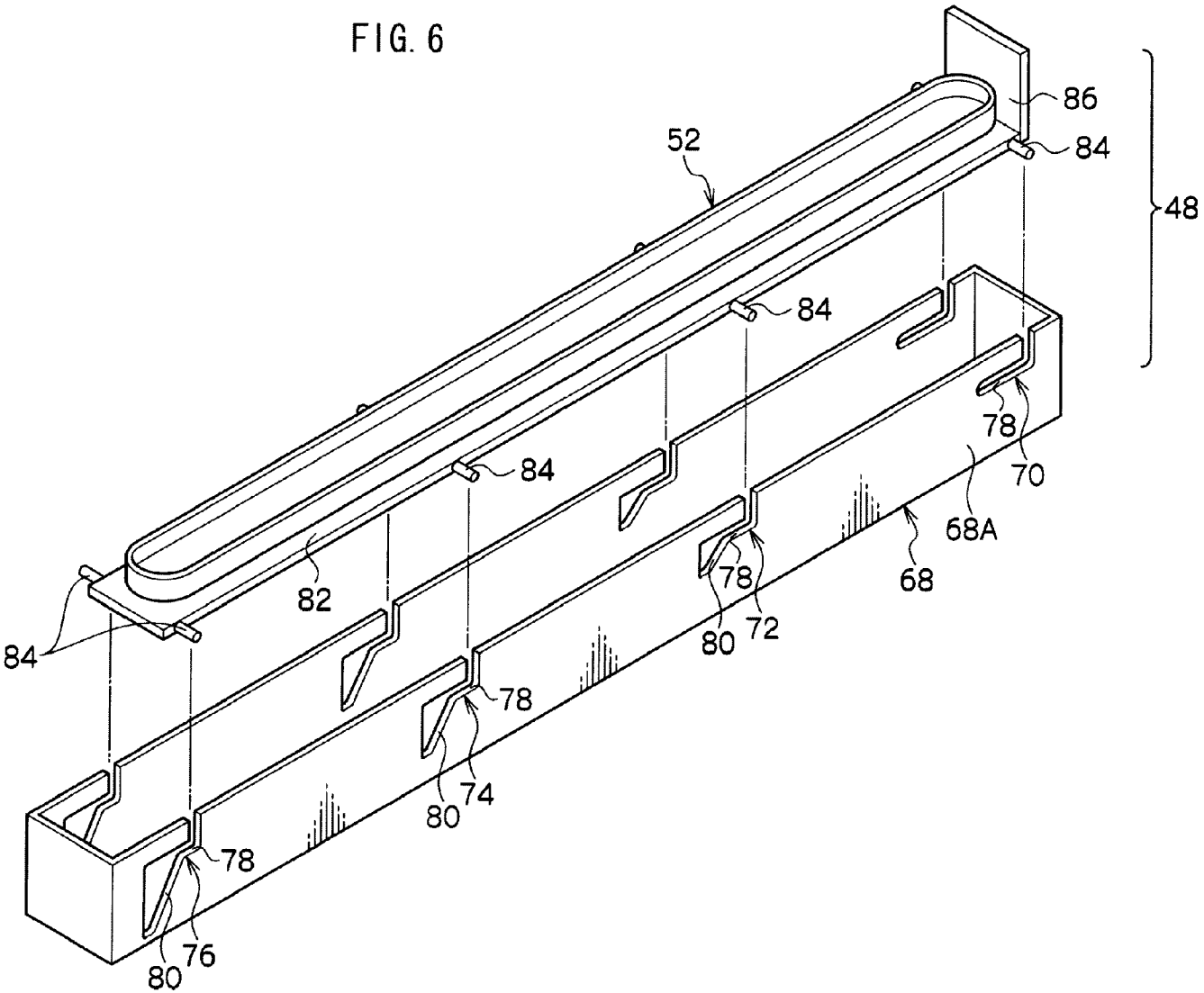
FIG. 6 is an exploded perspective view showing the structure of a capping unit structuring the inkjet recording device relating to the present exemplary embodiment.

As shown in FIG. 6, the maintenance unit 48 includes mainly a box body 68 that is rectangular parallel/piped shape and the capping member 52 that is shaped as a box and is accommodated to be movable (as will be described later) along the up/down direction and the longitudinal direction of the box body 68. Cam grooves 70, 72, 74, 76 are formed in side walls 68A that run along the longitudinal direction of the box body 68.

The shapes of the cam grooves 70, 72, 74, 76 are slightly different from one another. The cam grooves 70 form linear long grooves 78. At the cam grooves 72, 74, 76, inclined portions 80, that are inclined downward moving away from long grooves 78 which are similar to the long grooves 78 formed on the cam grooves 70, are connected to the long grooves 78.

The positions of the long grooves 78 of the cam grooves 70, 72, 74, 76 are substantially the same height. The lengths of the long grooves 78 are shorter at the cam grooves 74 than at the cam grooves 72, and the angles of inclination of the inclined portions 80 are steeper at the cam grooves 74 than at the cam grooves 72. Further, the lengths of the long grooves 78 are shorter at the cam grooves 76 than at the cam grooves 74, and the angles of inclination of the inclined portions 80 are steeper at the cam grooves 76 than at the cam grooves 74.

On the other hand, a long-plate-shaped holding plate 82 is provided at the lower portion of the capping member 52. Guide pins 84 project-out from the both end surfaces that run along the longitudinal direction of the holding plate 82, in correspondence with the cam grooves 70, 72, 74, 76.

Figures 7A, 7B, 7C:
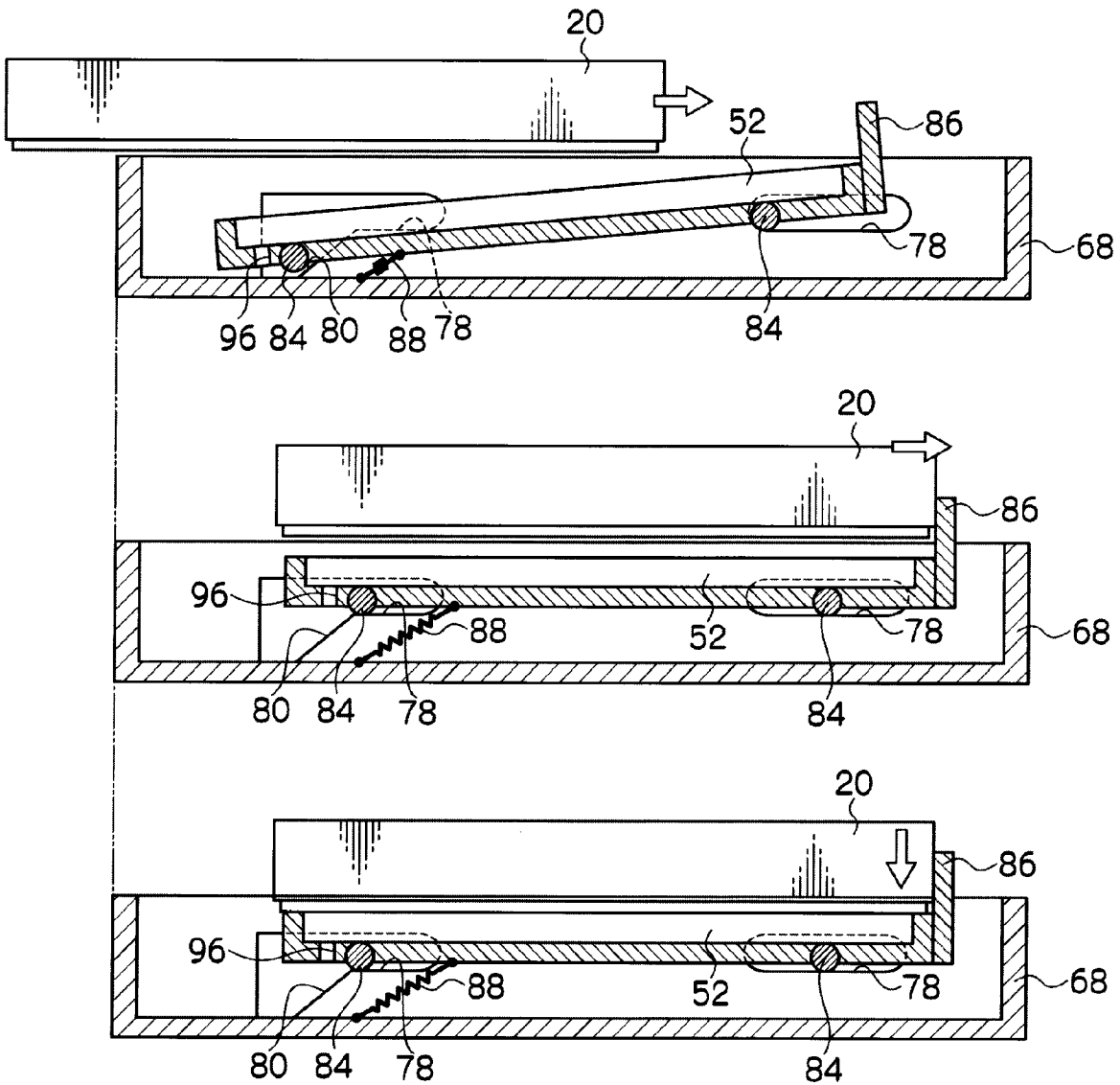
FIGS. 7A through 7C are schematic sectional views explaining operation of the capping unit structuring the inkjet recording device relating to the present exemplary embodiment.

As shown in FIG. 2, a push plate 86 is provided at the one end portion of the holding plate 82, which one end portion is positioned at the side opposite the transporting drum 26 side. As shown in FIGS. 7A through 7C (FIGS. 7A through 7C are drawings typifying the box body 68 and the capping member 52), the end surface of the inkjet recording head 20 can contact the push plate 86 such that the push plate 86 is pushed by the horizontal movement of the inkjet recording head 20.

One end portion of a coil spring (an urging member) 88 is attached to the other end portion of the holding plate 82. The other end portion of the coil spring 88 is attached to the box body 68. In the state of the coil spring 88 (see FIG. 7A), the capping member 52 is urged toward the transporting drum 26 within the box body 68.

In this state, the guide pins 84, that are engaged with the cam grooves 70 of the box body 68, are engaged with the long grooves 78. However, the other guide pins 84 are engaged with the inclined portions 80 of the cam grooves 72, 74, 76 (see FIG. 6), and, as shown in FIG. 7A, the capping member 52 is accommodated in a state of being tilted with respect to the box body 68.

On the other hand, as shown in FIG. 7B, when, due to horizontal movement of the inkjet recording head 20, the end surface of the inkjet recording head 20 contacts the push plate 86 of the holding plate 82 and pushes the push plate 86, the capping member 52 moves in a direction of moving away from the transporting drum 26 against the urging force of the coil spring 88.

Due thereto, the guide pins 84 move along the long grooves 78 of the cam grooves 70 of the box body 68, and the guide pins 84, that are engaging with the inclined portions 80 of the cam grooves 72, 74, 76 (see FIG. 6), move from the inclined portions 80 to the long grooves 78.

Because the positions of the long grooves 78 of the cam grooves 70, 72, 74, 76 are substantially the same heights, the capping member 52 is held horizontal. In this state, as shown in FIG. 7C, the inkjet recording head 20 moves toward the capping member 52, and an airtight (sealing) state is formed between the capping member 52 and the nozzle surface 22 of the inkjet recording head 20.

Figure 8A:
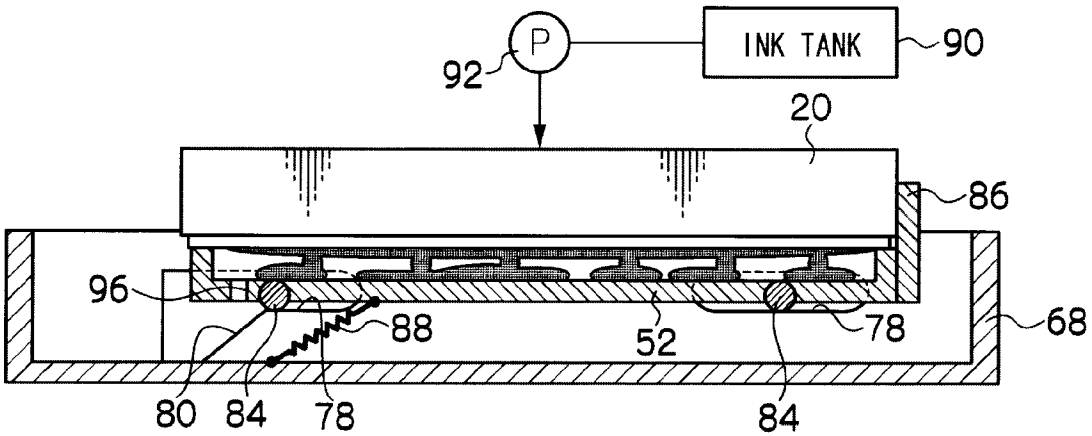
FIGS. 8A and 8B are schematic sectional views explaining operation of the capping unit structuring the inkjet recording device relating to the present exemplary embodiment, where

At this time, as shown in FIG. 8A, pressure is applied to the ink within the inkjet recording head 20 by using a pressure-applying pump (clogging preventing section) 92 that is for supplying ink from each ink tank 90 to the inkjet recording head 20. Due thereto, ink drops are ejected from the nozzles, and contaminating substances (ink that has hardened and the like) that are clogged within the nozzles are removed (contaminating substance removing process).

Figure 8B:
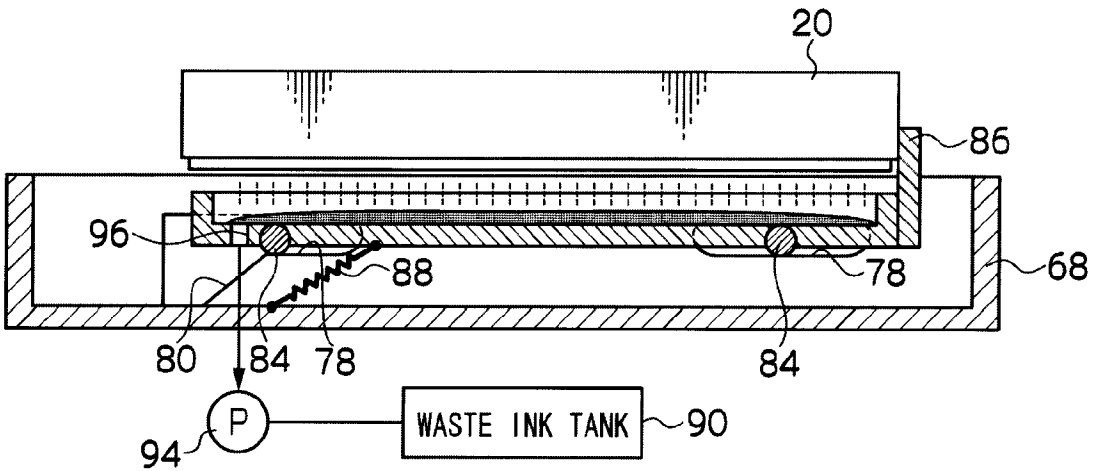

Other than the pressure-applying pump 92, as shown in FIG. 8B, by using a suction pump (clogging preventing section) 94 that sucks ink from the interior of the capping member 52 and that will be described later, the contaminating substances within the nozzles may be sucked out by the suction force of the suction pump 94. Hereinafter, the clogging preventing section will be described by using the suction pump 94.

Figure 9:
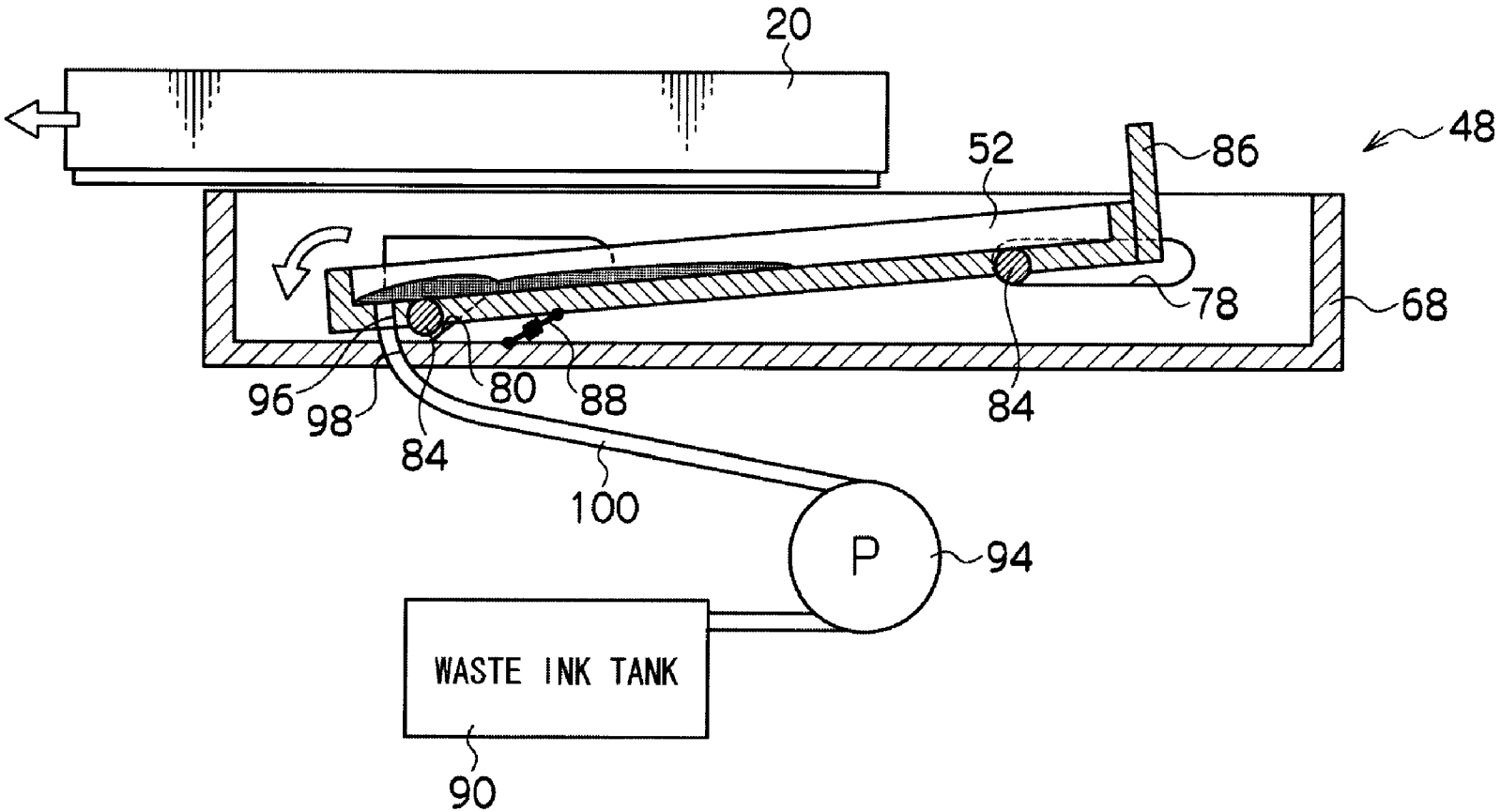
FIG. 9 is a schematic sectional view explaining operation of the capping unit structuring the inkjet recording device relating to the present exemplary embodiment.

When the process of removing contaminating substances from the nozzles of the inkjet recording head 20 ends, there is a state in which ink has accumulated at the floor surface of the capping member 52. However, as shown in FIG. 9, when the inkjet recording head 20 is moved away from the push plate 86, the capping member 52 is urged within the box body 68 by the coil spring 88 in a direction of approaching the transporting drum 26.

Due thereto, the guide pins 84 move following the shapes of the respective cam grooves 70, 72, 74, 76 (see FIG. 6), and the capping member 52 tilts within the box body 68. Due thereto, the ink that has accumulated within the capping member 52 can be gathered at one place thereat.

Here, by subjecting the inner wall surfaces of the capping member 52 to a water repelling treatment, the ink within the capping member 52 can be made to flow smoothly, and the ability to discharge the ink can be improved. Further, a discharge opening 96 is formed in the floor surface of the capping member 52, and the ink within the capping member 52 is discharged-out to the exterior through this discharge opening 96. A pass-through opening 98 is formed in the box body 68. One end portion of an elastic tube 100 is connected to the discharge opening 96 and, via the pass-through opening 98, the other end portion of the elastic tube 100 is connected to the suction pump 94.

As described above, the suction pump 94 is operated at the time when the airtight state between the capping member 52 and the nozzle surface 22 of the inkjet recording head 20 is formed, and the contaminating substances within the nozzles can be sucked. However, after the capping member 52 is tilted within the box body 68, the suction pump 94 is again operated and sucks the ink that is within the capping member 52 from the discharge opening 96 and can discharge it to waste ink tank 90.

Operation of the inkjet recording device 10, that is structured as described above, will be described next.

As shown in FIG. 1, the recording sheet P that is picked-up and held one-by-one from the sheet feeding section 12 by the grippers 30 of the pick-up drum 24, is transported while being stuck to the peripheral surface of the pick-up drum 24, and, at the transfer position 36, is transferred from the grippers 30 of the pick-up drum 24 to the grippers 30 of the transporting drum 26.

While being stuck to the transporting drum 26, the recording sheet P that is held by the grippers 30 of the transporting drum 26 is transported to the image recording position of the inkjet recording heads 20, and an image is formed on the printing surface thereof by ink drops ejected from the inkjet recording heads 20.

The recording sheet P on whose printing surface an image has been formed is, at the transfer position 38, transferred from the grippers 30 of the transporting drum 26 to the grippers 30 of the feed-out drum 28. Then, the recording sheet P that is held by the grippers 30 of the feed-out drum 28 is transported while being stuck to the feed-out drum 28, and is fed to the sheet discharging section 18. In this way, the series of image formation ends.

Figure 3:
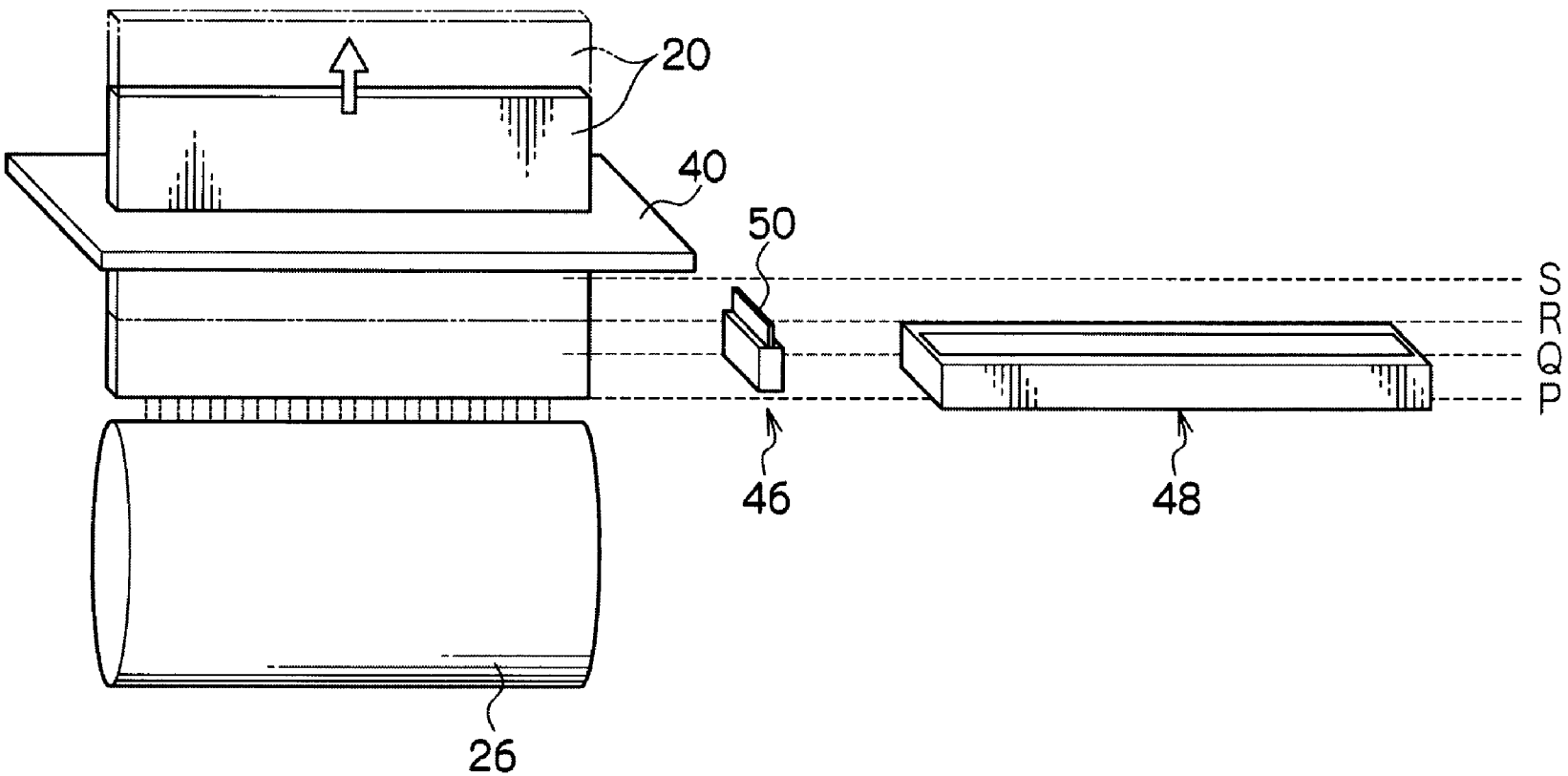
FIG. 3 is a schematic side view explaining operation of an inkjet recording head structuring the inkjet recording device relating to the present exemplary embodiment.

On the other hand, at the time of carrying out maintenance on the inkjet recording head 20, first, as shown in FIG. 3, the inkjet recording head 20 is moved from a recording height P (the solid line) at the time of image formation to a cleaning height R (the imaginary line).

At this time, the stepping motors 58 shown in FIG. 5 are driven, the ball screws 60 rotate, and the inkjet recording head 20 is moved, via the guide rails 54 and with respect to the head holder 40, upward along the radial direction of the transporting drum 26 (recording height P shown in FIG. 3→cleaning height R). As shown in FIG. 4, this cleaning height R is a height at which the wiper unit 46 and the nozzle surface 22 of the inkjet recording head 20 can contact.

Next, as shown in FIG. 4, the head holder 40 moves horizontally along the frame body 44 (illustration of the frame body 44 is omitted here) in a direction of withdrawing from the region above the transporting drum 26. Because the wiper blade 50 that structure the wiper unit 46 is disposed on the locos of movement of the inkjet recording head 20, due to the horizontal movement of the head holder 40, the nozzle surface 22 of the inkjet recording head 20 is slidingly rubbed by the wiper blade 50 (cleaning process). The contaminating substances and the like, that adhere to the nozzle surface 22 of the inkjet recording head 20, are thereby removed.

Here, as shown in FIG. 7A and FIG. 7B, the push plate 86 of the capping member 52 that structure the maintenance unit 48 is disposed on the locus of movement of the inkjet recording head 20. The capping member 52 is pushed by the end surface of the inkjet recording head 20 via the push plate 86 against the urging force of the coil spring 88. Due thereto, the guide pins 84 move via the cam grooves 70, 72, 74, 76, and the capping member 52 is held horizontal from the state in which it is inclined with respect to the box body 68.

Figure 10:
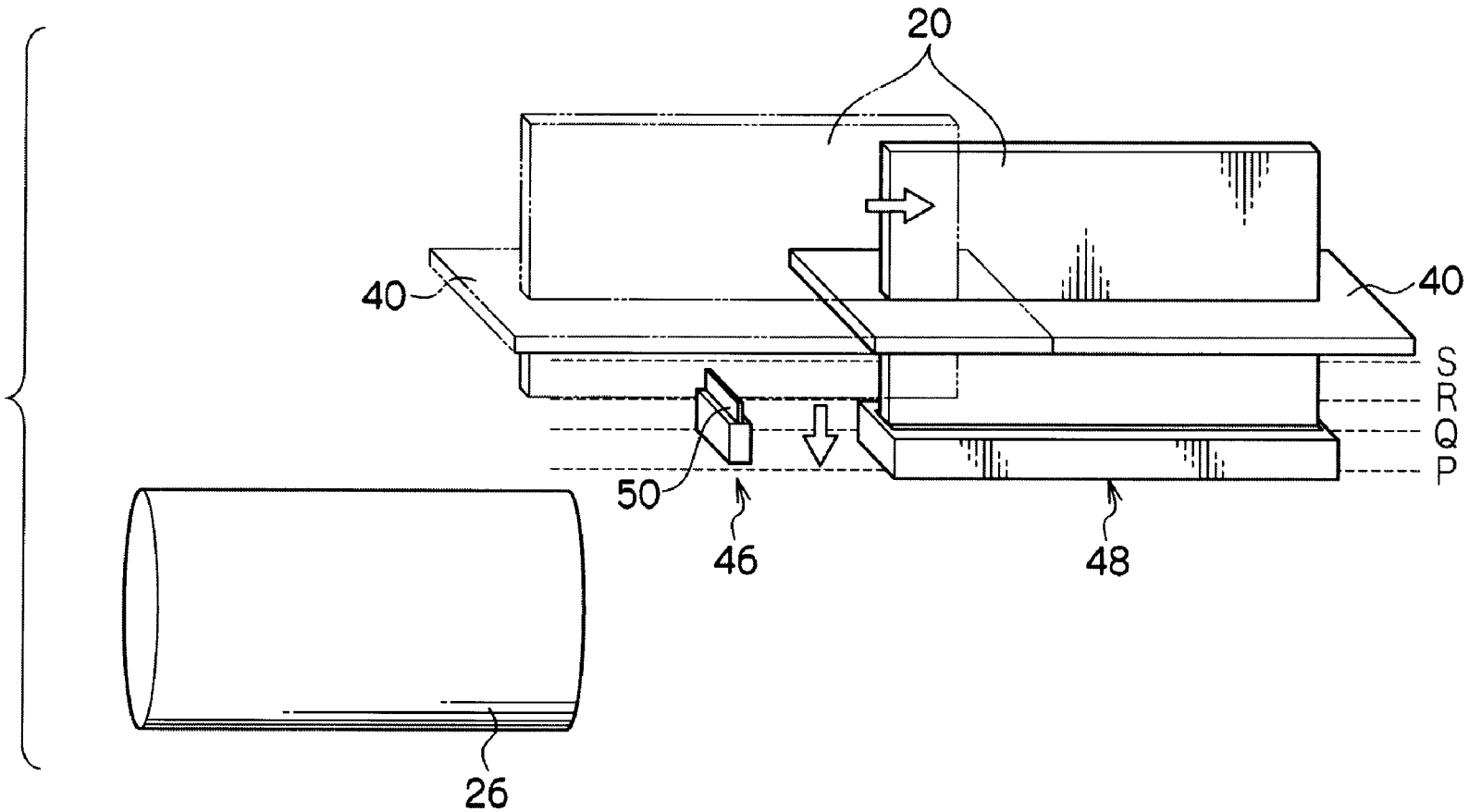
FIG. 10 is a schematic side view explaining operation of the inkjet recording head structuring the inkjet recording device relating to the present exemplary embodiment.

In this state, as shown in FIG. 7B, a gap is provided between the capping member 52 and the nozzle surface 22 of the inkjet recording head 20. From this state, the stepping motors 58 shown in FIG. 5 are driven, and each inkjet recording head 20 moves downward along radial direction of the transporting drum 26 with respect to the head holder 40 (cleaning height R shown in FIG. 10→attached height Q). Due thereto, as shown in FIG. 7C, the nozzle surface 22 is covered by the capping member 52 and is in airtight state.

Next, as shown in FIG. 8B, the interior of the capping member 52 is made to be negative pressure by the suction pump 94, and the liquid within the nozzles of the inkjet recording head 20 is sucked (contaminating substance removing process). Clogs and the like within the nozzles due to contaminating substances such as hardened ink and the like are thereby eliminated.

Here, as shown in FIG. 7C, by disposing the capping member 52 substantially parallel to the nozzle surface 22, the nozzle interiors are sucked by the suction pump 94, and at the time of ejecting toward the capping member 52, dispersion of the suction forces at the nozzles does not arise.

Figure 11:
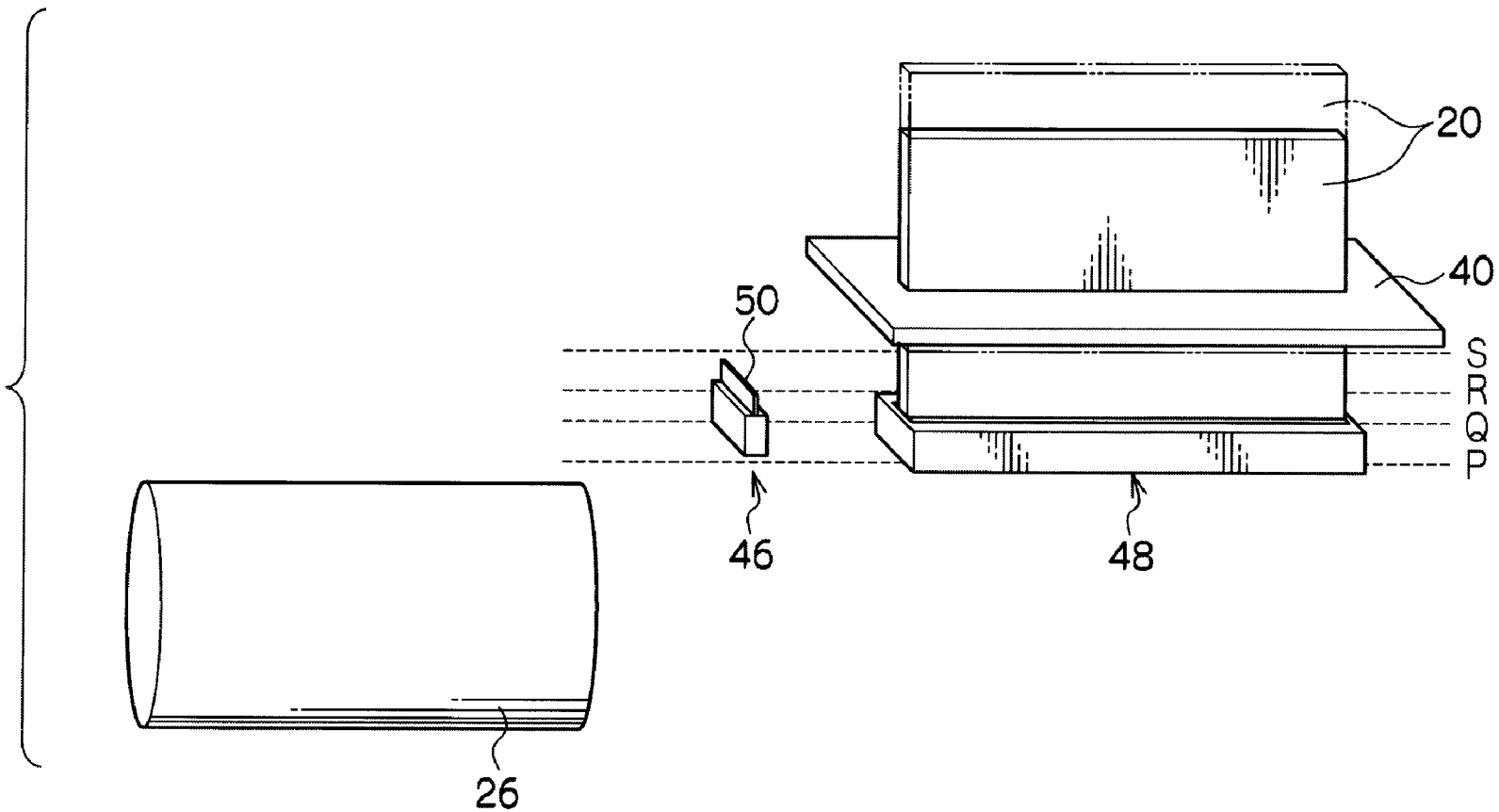
FIG. 11 is a schematic side view explaining operation of the inkjet recording head structuring the inkjet recording device relating to the present exemplary embodiment.

In the contaminating substance removing process, the capping member 52 is disposed horizontally with respect to the box body 68. However, when the contaminating substance removing process ends, the stepping motors 58 shown in FIG. 5 are driven, and as shown in FIG. 11, each inkjet recording head 20 moves upward along radial direction of the transporting drum 26 with respect to the head holder 40, and move away from the capping member 52 (withdrawn height S). Then, the inkjet recording head 20 moves via the head holder 40 in a direction orthogonal to the transporting direction of the recording sheet P.

Here, the withdrawn height S is higher than the cleaning height R. When the head holder 40 is slidingly moving, the nozzle surface 22 of the inkjet recording head 20 does not contact the wiper blade 50.

On the other hand, when the inkjet recording head 20 moves from the attached height Q to the withdrawn height S, as shown in FIG. 9, the end surface of the inkjet recording head 20 moves away from the push plate 86 of the capping member 52.

Due thereto, the guide pins 84 move via the cam grooves 70, 72, 74, 76 (see FIG. 6) by the urging force of the coil spring 88, and the capping member 52 tilts with respect to the box body 68. The ink that has accumulated within the capping member 52 gathers toward the discharge opening 96 side, is sucked through the discharge opening 96 by the suction pump 94, and is discharged to the waste ink tank 90.

Figure 12:
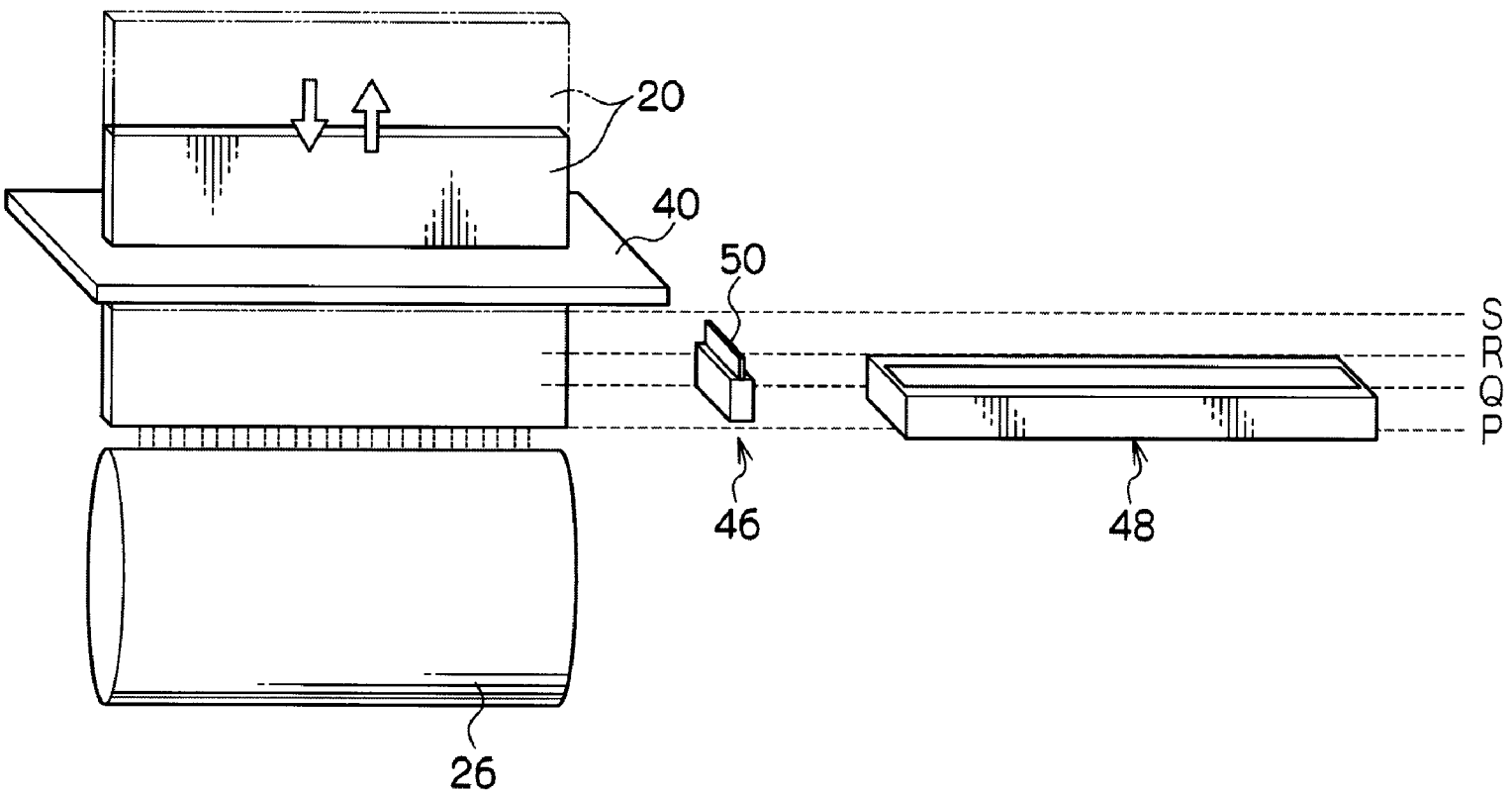
FIG. 12 is a schematic side view explaining operation of the inkjet recording head structuring the inkjet recording device relating to the present exemplary embodiment.

Then, as shown in FIG. 12, when the inkjet recording head 20 moves to the position facing the transporting drum 26, the stepping motors 58 shown in FIG. 5 are driven, and each inkjet recording head 20 moves downward along radial direction of the transporting drum 26 with respect to the head holder 40 (withdrawn height S→recording height P).

In this way, the inkjet recording heads 20 in accordance with the present exemplary embodiment are, as shown in FIG.

13A, mounted to the head holder 40 with the mounting angles thereof differing from one another along the peripheral direction of the outer peripheral surface of the transporting drum 26, and can move up and down (approach and move away) along radial directions of the transporting drum 26. Further, at the time of carrying out maintenance on the inkjet recording heads 20, the inkjet recording heads 20 are moved in the up and down directions, and are moved close or withdrawn in directions of approaching-and-moving-away from the transporting drum 26 or the capping units 48.

Figure 13B:
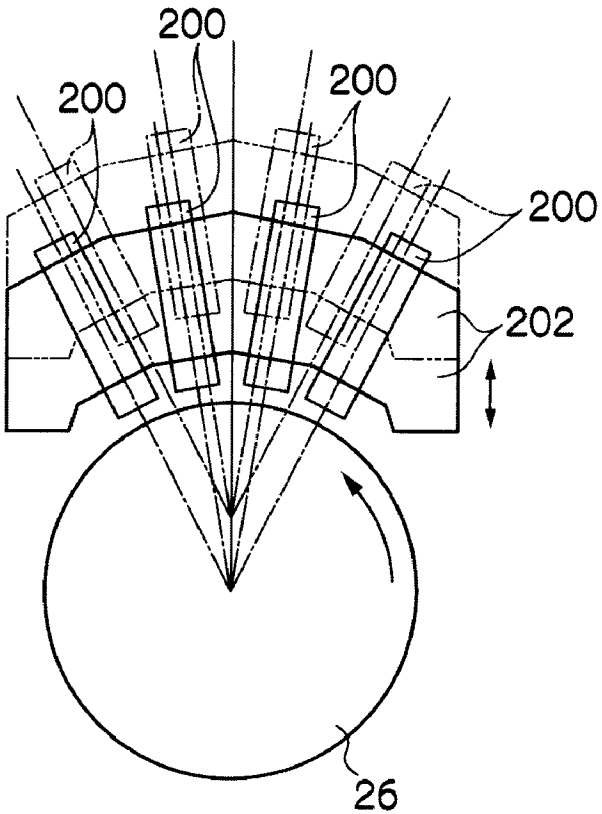
FIG. 13B is a comparative example thereof.

On the other hand, as shown in FIG. 13B, in a state in which inkjet recording heads 200 are fixed to a head holder 202 with the mounting angles thereof differing from one another, when the head holder 202 is moved in vertical direction, if the position of the head holder 202 is offset in the heightwise direction, the landing positions at which the inks from the inkjet recording heads 200 land are offset greatly on the transporting drum 26.

Because the image quality deteriorates greatly when the landing positions of the inks of the respective colors are offset in this way, a highly-precise height controlling mechanism is needed. Further, each time the height of the inkjet recording heads 200 is changed, there is the need for fine adjustment of the height of the head holder 202 so that the landing positions of the inks of the respective inkjet recording heads 200 match on the recording sample.

Namely, by making the inkjet recording heads 200, that are disposed with the mounting angles thereof differing from one another, vertically move integrally with the head holder 202, the mounting angles of the inkjet recording heads 200 with respect to the recording sheet P change. Therefore, an error in the heightwise direction of the head holder 202 greatly affects the landing positions of the inks.

Figure 13A:
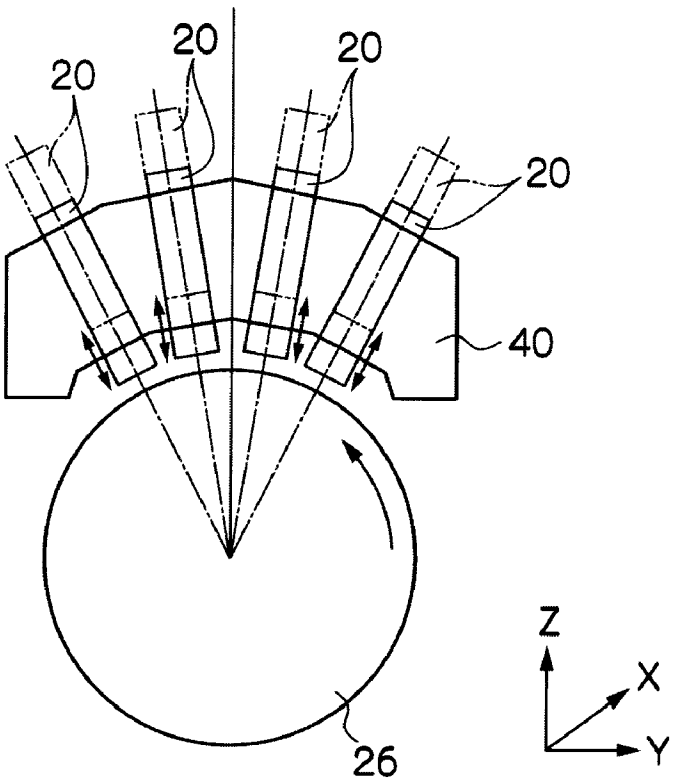
FIG. 13A is a schematic diagram explaining operation of the inkjet recording device relating to the present exemplary embodiment.

However, as shown in FIG. 13A, in accordance with the present exemplary embodiment, the inkjet recording heads 20 move up and down along radial directions of the transporting drum 26. Therefore, the mounting angles of the inkjet recording heads 20 do not change.

Thus, the affections that errors in the heightwise directions of the inkjet recording heads 20 have on the landing positions of the ink are smaller than in a case in which the head holder 202 is moved vertically, and it is difficult for offset of the landing positions of the inks to arise.

In the present exemplary embodiment, as described above, the heights of the inkjet recording head 20 shown in FIG. 3 are the recording height P, the cleaning height R, the attached height Q, and the withdrawn height S.

Here, the recording height P is the height at the time when the inkjet recording head 20 ejects ink toward the recording sheet P on the transporting drum 26. The cleaning height R is the height at the time when the nozzle surface 22 of the inkjet recording head 20 contacts the wiper blade 50 and cleaning is carried out when the inkjet recording head 20 moves horizontally by the head holder 40.

Further, the attached height Q is the height at the time when nozzle surface 22 of the inkjet recording head 20 faces the capping member 52 and attached to the capping member 52 and the ink within the nozzles is removed. The withdrawn height S is the height at which the nozzle surface 22 does not contact the wiper blade 50 when the inkjet recording head 20 moves horizontally by the head holder 40.

The relationships between the recording height P, the cleaning height R, the attached height Q and the withdrawn height S are as follows.

The recording height P<the attached height Q<the cleaning height R<the withdrawn height S.

By changing the heights of the inkjet recording heads 20 in accordance with the respective processes in this way, there is no need to move the wiper blades 50, the capping members 52 and the like, and the structure of the inkjet recording device 10 is simple as compared with a case in which mechanisms that move the wiper blades 50 and the capping members 52 are provided.

Further, as shown in FIG. 3, the inkjet recording head 20 is moved upward from the recording height P to the cleaning height R, and thereafter, as shown in FIG. 4, the head holder 40 is moved horizontally and the nozzles surface 22 of the inkjet recording head 20 slidingly rubs the wiper blade 50 such that the cleaning process is carried out.

Figure 14:
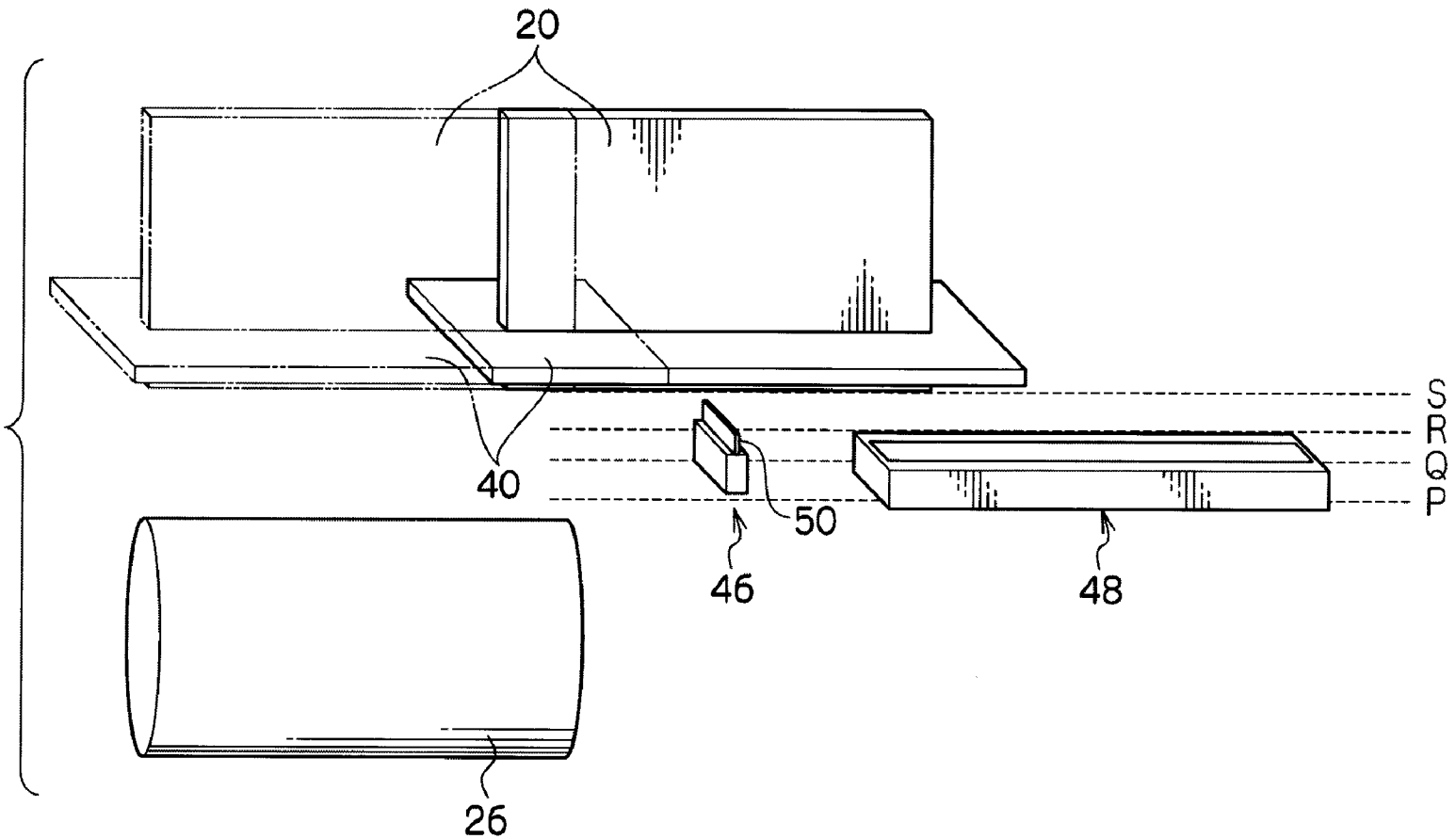
FIG. 14 is a schematic side view explaining operation of the inkjet recording head structuring the inkjet recording device relating to the present exemplary embodiment.

Then, in the state in which the inkjet recording head 20 faces the capping unit 48, the inkjet recording head 20 is moved downward to the attached height Q (see FIG. 10), and the contaminating substance removing process of the nozzles by the suction pump 94 is carried out. Thereafter, the inkjet recording head 20 is moved upward to the withdrawn height S (see FIG. 11), and the head holder 40 is moved horizontally (see FIG. 14) and the inkjet recording head 20 is moved downward to the recording height P (see FIG. 12). However, it is not absolutely necessary to carry out all of these processes.

Further, because each of the inkjet recording heads 20 can be moved up and down independently of the others, the sliding-rubbing of the nozzle surface 22 of the inkjet recording head 20 by the wiper blade 50 can be selected per inkjet recording head 20.

Thus, depending on the inkjet recording head 20, the contaminating substance removing process may be carried out without carrying out the cleaning process. In this case, that inkjet recording head 20 moves upward from the recording height P shown in FIG. 12 to the withdrawn height S, and after being moved horizontally by the head holder 40, is moved downward from the withdrawn height S to the attached height Q as shown in FIG. 11. Of course, all of the inkjet recording heads 20 may be made able to move up and down collectively.

Further, in the present exemplary embodiment, as shown in FIG. 3, the inkjet recording head 20 is moved upward from the recording height P to the cleaning height R, and thereafter, as shown in FIG. 4, the head holder 40 is moved horizontally and the cleaning process is carried out by the nozzle surface 22 of the inkjet recording head 20 slidingly-rubbing (being wiped by) the wiper blade 50. However, first, ink may be made to overflow-out from the nozzles of the inkjet recording head 20 and the ink may be coated on the entire nozzle surface 22 by the wiper blade 50, and thereafter, the nozzle surface 22 may be wiped by the wiper blade 50.

In the case of using highly-viscous inks, the ink that adheres to the nozzle surface 22 thickens or hardens at an early stage. Therefore, it is difficult to clean the nozzle surface 22 cleanly merely by wiping by the wiper blade 50.

Therefore, by making the ink overflow-out from the nozzles and moving the inkjet recording head 20 to a coating height T and coating the ink on the entire nozzle surface 22 by the wiper blade 50, the ink that has adhered to the nozzle surface 22 is dissolved. Then, thereafter, by moving the inkjet recording head 20 to the cleaning height R and wiping the nozzle surface 22 by the wiper blade 50, the nozzle surface 22 can be cleaned cleanly even if the ink is highly viscous.

Figure 15:
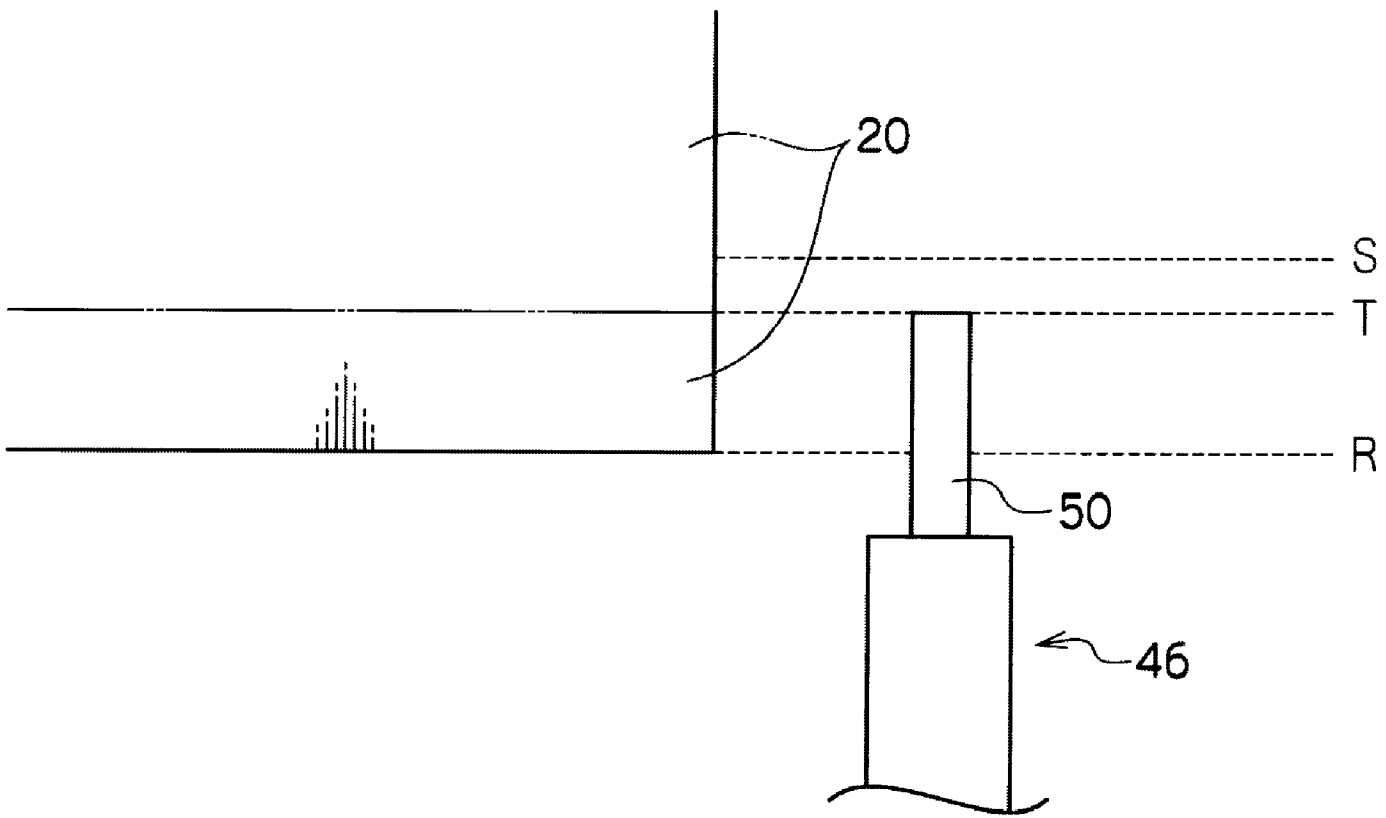
FIG. 15 is an explanatory diagram explaining operation of the inkjet recording head structuring the inkjet recording device relating to the present exemplary embodiment.

In this case, in addition to the cleaning process, a coating process is added. As shown in FIG. 15, the coating height T is added separately from the cleaning height R to the heights of the inkjet recording heads 20.

Here, at the cleaning height R, the amount of contact between the nozzle surface 22 of the inkjet recording head 20 and the wiper blade 50 is about 0.5 to 2 mm (note that this amount of contact differs in accordance with the material of the wiper blade 50 and the like). However, at the coating height T, the amount of contact between the nozzle surface 22 of the inkjet recording head 20 and the wiper blade 50 is around −3 to 0 mm, and, depending on the types of the inks, there is also a case in which the nozzle surface 22 do not contact the wiper blade 50.

Further, by coating the ink on the nozzle surface 22 by the wiper blade 50, the ink that has adhered to the nozzle surface 22 is dissolved. Therefore, the time until the ink-harden is the reference for the holding time from after the ink is coated on the nozzle surface 22 until the wiping by the wiper blade 50 is started. Thus, for the ink that is generally used at the inkjet recording head 20, the holding time is preferably about 1 to 300 seconds, although it depends on the types of the inks as well.

Because the nozzle surface 22 is wiped by the wiper blade 50 after the ink is coated on the entire nozzle surface 22 once by the wiper blade 50, the inkjet recording head 20 moves reciprocally with respect to the wiper blade 50.

Thus, after the nozzle surface 22 is wiped by the wiper blade 50, the inkjet recording head 20 is disposed above the transporting drum 26. Accordingly, if the contaminating substance removing process is to be carried out thereafter, the inkjet recording head 20 is moved upward (the withdrawn height S), and thereafter, the head holder 40 is moved horizontally.

Note that, although the contaminating substance removing process by the capping member 52 is described here, other than this, the ink may be ejected to a region of the transporting drum 26 that is other than the region that the recording sheet P contacts. After the ink is coated on the entire nozzle surface 22 by the wiper blade 50 and the nozzle surface 22 is wiped by the wiper blade 50, the inkjet recording head 20 is disposed above the transporting drum 26. Therefore, by causing the ink to be ejected onto the transporting drum 26 as is, further movement of the inkjet recording head 20 can be eliminated.

Figure 16:
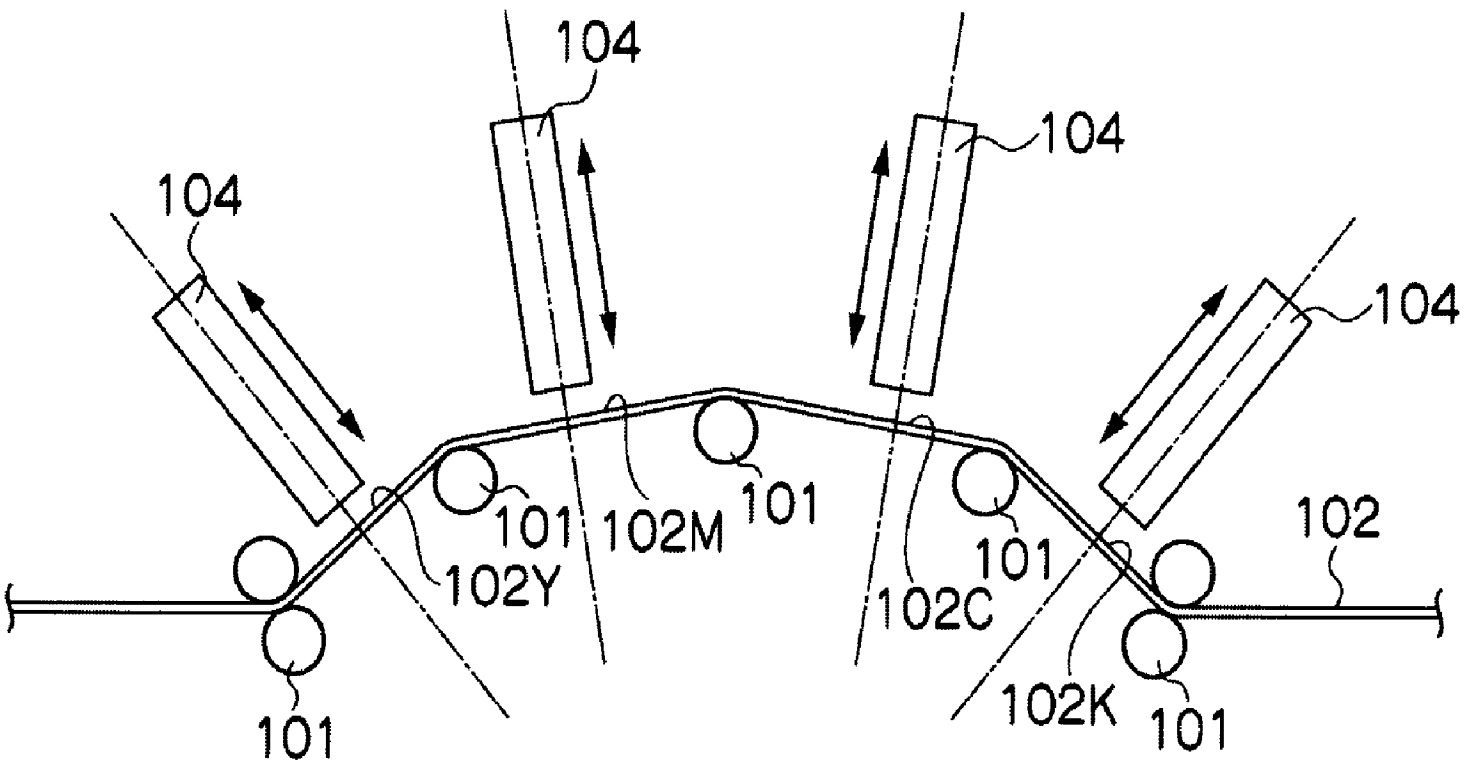
FIG. 16 is a schematic front view showing a modified example of the inkjet recording device relating to the present exemplary embodiment.

Further, here, the recording sheet P is transported by the transporting drum 26 that serves as a transporting body. However, the present invention is not limited to a rotating body such as the transporting drum 26. For example, as shown in FIG. 16, a structure may be utilized in which a transporting belt 102, that has recording surfaces 102Y, 102M, 102C, 102K of angles that differ in accordance with stretching rollers 101 or the like, and inkjet recording heads 104 face one another. In this case, the respective inkjet recording heads 104 are disposed with the mounting angles thereof differing from one another, such that the respective recording surfaces 102Y, 102M, 102C, 102K of the transporting belt 102 and the nozzle surfaces of the inkjet recording heads 104 face each other.

Moreover, the present invention can be applied as well to a structure in which respective inkjet recording heads are disposed parallel to one another with respect to a planar transporting belt, although the affections that errors in the heightwise direction of the inkjet recording heads have on the landing positions of the inks are not as great as compared with cases in which the above-described transporting bodies are used.

What is claimed is:

1. A droplet ejecting device comprising:

a plurality of droplet ejecting heads that eject droplets;

a transporting body, disposed to face nozzle surfaces of the droplet ejecting heads, that transports a recording medium;

a head holding member that holds the droplet ejecting heads movably along droplet ejecting directions respectively;

a horizontal moving unit that moves the head holding member horizontally so as to be able to withdraw the droplet ejecting heads from positions at which the droplet ejecting heads face the transporting body;

cleaning units that respectively contact the nozzle surfaces of the droplet ejecting heads being moved horizontally by the horizontal moving unit, and clean the nozzle surfaces; and capping units that are respectively configured to attach to the nozzle surfaces of the droplet ejecting heads that are withdrawn by the horizontal moving unit from the positions at which the droplet ejecting heads face the transporting body;

wherein the droplet ejecting heads move to:

a recording height at which the droplet ejecting heads elect droplets onto the recording medium on the transporting body;

a cleaning height at which the nozzle surfaces of the droplet ejecting heads contact the cleaning units and the cleaning units clean the nozzle surfaces when the droplet ejecting heads are moved horizontally by the horizontal moving unit;

an attached height at which the nozzle surfaces of the droplet ejecting heads are attached to the capping units; and a withdrawn height at which the droplet ejecting heads do not contact the cleaning units when the droplet ejecting heads are moved horizontally by the horizontal moving unit, the heights being set such that the recording height<the attached height<the cleaning height<the withdrawn height.

2. The droplet ejecting device of claim 1, wherein the transporting body is a cylindrical body, and the droplet ejecting heads are disposed along a peripheral direction of an outer peripheral surface of the cylindrical body, such that mounting angles of the droplet ejecting heads differ from one another.

3. The droplet ejecting device of claim 1, wherein the capping units are connected to a clogging preventing unit that applies suction or pressure to the nozzle surfaces attached to the capping units.

4. The droplet ejecting device of claim 1, wherein each of the capping units includes:

a capping member to which the nozzle surface of the droplet ejecting head is attached;

a box body that accommodates the capping member tiltably;

cam portions provided at the box body and the capping member, and that hold the capping member horizontal when the nozzle surface of the droplet ejecting head is attached to the capping member; and an urging member, whose urging force accumulates in a state in which the capping member is held horizontal by the cam portions, and that tilts the capping member with respect to the box body when the nozzle surface of the droplet ejecting head is separated from the capping member.

5. The droplet ejecting device of claim 4, wherein the capping member is formed in a box shape, and an inner wall surface of the capping member is subjected to a water repelling treatment.

6. The droplet ejecting device of claim 4, wherein a pushed member is provided at each capping member, the pushed member being configured to be pushed by the droplet ejecting head when the droplet ejecting head moves horizontally due to the horizontal movement of the head holding member.

7. The droplet ejecting device of claim 6, wherein the capping member is held horizontal via the cam portions and by the push member being pushed by the droplet ejecting head.

8. The droplet ejecting device of claim, wherein the droplet ejecting heads move to the cleaning height after the droplet ejecting heads move to a coating height at which liquid droplets overflowing-out from nozzles of the droplet ejecting heads are coated on the entire nozzle surfaces by contacting the cleaning units when the droplet ejecting heads are moved horizontally.

9. A droplet electing device comprising:

a plurality of droplet electing heads that eject droplets;

a transporting body, disposed to face nozzle surfaces of the droplet ejecting heads, that transports a recording medium;

a head holding member that holds the droplet ejecting heads movably along droplet ejecting directions respectively; and up and down mechanisms for the respective droplet ejecting heads are provided at the head holding member, the up and down mechanisms moving the droplet ejecting heads along the droplet ejecting directions respectively.

10. The droplet ejecting device of claim 9, wherein the transporting body is a cylindrical body, and the up and down mechanisms move the droplet ejecting heads along radial directions of the cylindrical body respectively.

11. A droplet ejecting device comprising:

a plurality of droplet ejecting heads that eject droplets;

a transporting body, disposed to face nozzle surfaces of the droplet ejecting heads, that transports a recording medium;

a head holding member that holds the droplet ejecting heads movably along droplet ejecting directions respectively;

a horizontal moving unit that moves the head holding member horizontally so as to be able to withdraw the droplet ejecting heads from positions at which the droplet ejecting heads face the transporting body; and up and down mechanisms for the respective droplet ejecting heads that are provided at the head holding member, the up and down mechanisms moving the droplet ejecting heads along the droplet ejecting directions respectively.

12. The droplet ejecting device of claim 11, further comprising:

cleaning units that respectively contact the nozzle surfaces of the droplet ejecting heads being moved horizontally by the horizontal moving unit, and clean the nozzle surfaces; and capping units that are respectively configured to attach to the nozzle surfaces of the droplet ejecting heads that are withdrawn by the horizontal moving unit from the positions at which the droplet ejecting heads face the transporting body.

* * * * *